US007206379B2

(12) United States Patent
Lemaitre

(10) Patent No.: US 7,206,379 B2
(45) Date of Patent: Apr. 17, 2007

(54) RF ACCELERATOR FOR IMAGING APPLICATIONS

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 126 days.

(21) Appl. No.: 10/904,229

(22) Filed: Oct. 29, 2004

(65) Prior Publication Data

US 2005/0111625 A1 May 26, 2005

Related U.S. Application Data

(60) Provisional application No. 60/524,987, filed on Nov. 25, 2003.

(51) Int. Cl.
*H01J 35/02* (2006.01)
*H05G 2/00* (2006.01)

(52) U.S. Cl. ..... 378/122; 378/119; 378/121; 378/124; 315/501

(58) Field of Classification Search ..... 378/119, 378/121, 122, 124; 315/501
See application file for complete search history.

(56) References Cited

U.S. PATENT DOCUMENTS 3,239,711 A * 3/1966 Norris ..... 315/3.5
3,463,959 A * 8/1969 Trivelpiece et al. ..... 315/5
4,122,342 A 10/1978 Vali et al. ..... 378/70
4,287,425 A 9/1981 Elliott, Jr. ..... 378/10
4,641,103 A * 2/1987 Madey et al. ..... 315/507
4,746,839 A * 5/1988 Kazusa et al. ..... 315/5.41
5,227,701 A * 7/1993 McIntyre ..... 315/5.41
5,635,721 A * 6/1997 Bardi et al. ..... 250/492.3
5,814,940 A 9/1998 Fujisawa ..... 315/5.41
5,825,140 A 10/1998 Fujisawa ..... 315/505
5,917,293 A 6/1999 Saito et al. ..... 315/505
6,060,833 A * 5/2000 Velazco ..... 315/5.41
6,115,454 A * 9/2000 Andrews et al. ..... 378/140
6,201,851 B1 3/2001 Piestrup et al. ..... 378/121
6,327,339 B1 12/2001 Chung et al. ..... 378/121
6,376,990 B1 * 4/2002 Allen et al. ..... 315/5.41
6,407,505 B1 * 6/2002 Bertsche ..... 315/5.41
6,493,424 B2 * 12/2002 Whitham ..... 378/137
6,617,810 B2 * 9/2003 Symons ..... 315/500
6,864,633 B2 * 3/2005 Trail et al. ..... 315/5.41
6,987,361 B1 * 1/2006 Lewellen et al. ..... 315/5.35
7,068,749 B2 * 6/2006 Kollegal et al. ..... 378/10

* cited by examiner

*Primary Examiner*—Edward J. Glick
*Assistant Examiner*—Thomas R. Artman

(57) ABSTRACT

The present invention is an RF cavity for accelerating electrons in imaging applications such as x-ray tubes and CT applications. An RF cavity having electron emitters placed therein accelerates the electrons across the cavity. The geometric shape of the cavity determines the electromagnetic modes that are employed for the acceleration of electrons. The fast electrons are used to generate x-rays by interacting with a target, either a solid or a liquid target. The electron accelerator may be used in an arc source for a stationary computed tomography application, in an x-ray tube, as a booster for an electron gun, and other imaging applications.

8 Claims, 3 Drawing Sheets

RF ACCELERATOR FOR IMAGING APPLICATIONS

CROSS-REFERENCE TO RELATED APPLICATIONS

This application claims priority to provisional patent application No. 06/524,987 filed on Nov. 25, 2003, now abandoned.

TECHNICAL FIELD

The present invention relates generally to a source for generating an electron beam and more particularly to a microwave driven electron beam for imaging applications such as stationary CT applications and x-ray tubes.

BACKGROUND OF THE INVENTION

Computerized tomographic (CT) scanners employ radiation from x-ray tubes. The radiation is focused on a target and the target is typically an arrangement of x-ray detectors that are positioned such that a tomographic image of one or more slices through a subject is reconstructed to produce an image.

The x-ray tube assembly typically operates with high voltage fed by control leads that pass through the housing into the tube. During operation, electrons are emitted from a source, usually a heated filament within a cathode, and accelerated to a focal spot located on the anode, or target. Upon striking the anode, x-rays are emitted from the focal spot as Bremstrahlung and characteristic radiation. The sources are typically high voltage sources. Such high voltage operation severely limits design aspects of the x-ray apparatus because it requires the high voltage to be insulated from other components of the x-ray tube. High voltage insulators are typically bulky and expensive.

In typical CT applications available today the x-ray tube and x-ray detector rotate on a gantry about three times per second around a patient located at the center of the gantry. Faster rotation speeds are desirable for imaging applications. For example, the motion of the heart can be effectively stopped if the information for an image can be obtained within a time period shorter than the time between two of the patient's heartbeats. However, rapidly growing centripetal forces due to increased gantry speed severely limit the tube's operation.

By contrast, in a stationary CT application, the x-ray source is a stationary arc source with distributed focal spots that can be activated by a control unit. The arc source would employ a large insulator to hold off the high operating voltage, which is on the order of 150 kV or larger. The insulator must be large which poses problems of cost, space, weight, and reliability concerns. A large insulator is very costly and very bulky adding considerable size and weight to the equipment.

To make the stationary CT source concept feasible, there is a need for reducing the cost and complexity of x-ray tubes and the arc source while generating high power x-rays.

In traditional x-ray tubes solid insulation is used to enable the generation of static electric fields for electron acceleration. Typically the cathode is at high negative voltage. For bipolar tubes this voltage is about −60 kV to −70 kV and for monopolar tubes this voltage typically ranges from −80 kV to −140 kV. However, applications employing voltages up to −200 kV are being discussed and lower voltages in the range of −30 kV are typical for mammography applications. For the higher electric fields more solid insulation is typically needed, thereby increasing the likelihood of failure under operation due to material defects. Failures of solid insulation are either surface flashovers or electrical breakdown in the bulk of the material. In both events the properties of the solid insulation are typically permanently changed, which requires the replacement of the x-ray tube.

Another disadvantage of solid insulation is the need to provide cathode supplies and controls on a high-voltage level. Examples are the filament drive supply, tube emission current controls and bias voltage supplies for electrostatic electron beam deflection. In each one of these examples at least one electrical feedthrough is required, that connects the signal from the high voltage end of the tube into the vacuum through the solid insulation. Generally feedthroughs increase the cost and complexity of the solid insulation and degrade the overall reliability of the solid insulation itself. Additionally, active electronic controls that are operated at high voltage levels to provide bias voltages are specifically susceptible to being damaged as a consequence of transient high voltage events, also called spits.

Another disadvantage of using dc electric fields in x-ray tubes, especially for CT, is the need for dual energy applications, which are of particular clinical value in differentiating cancerous tissue and benign calcification. In dual energy applications, two subsequent images are generated using electron beams at different cathode potentials. As an example consider alternating cathode potentials between −60 kV and −140 kV at a rate of 6 kHz. Due to limitations caused by the typical capacitive and inductive load of state-of-the-art generators, x-ray tubes, and connecting cable assemblies, such a square high-voltage waveform at 6 kHz cannot be achieved.

SUMMARY OF THE INVENTION

The invention is a radio frequency (RF) cavity for accelerating electrons in imaging applications such as x-ray tubes and CT applications. More specifically for stationary CT applications the RF cavity is configured as an arc-shaped, evacuated, waveguide of appropriate cross section having electron emitters placed therein which accelerate the electrons across the waveguide. The geometric shape of the cavity determines the electromagnetic modes that are employed for the acceleration of electrons. For simplicity but without limiting the scope of the invention, a rectangular waveguide is described herein. However, it should be understood that the geometry of the cavity could be modified to achieve the desired electron distribution. In the most general form the geometry of the cavity is determined using a numerical method.

The electrons accelerated by the cavity are used to generate x-rays by interacting with a solid or liquid target. The electron accelerator may be used in an arc source for a stationary computed tomography application, in an x-ray tube, as a booster for an electron gun, and other imaging applications. For example, the electron accelerator may be used to replace static high voltage means in traditional x-ray tubes. There is no need for a high voltage insulator, thereby eliminating the drawbacks associated therewith.

In an RF cavity higher electron energies are realized by simply increasing the RF power. RF electrical fields are sustained inside the vacuum. Electrical breakdown in a vacuum is typically reversible and the unit does not have to be replaced.

All cathode supplies and controls in an x-ray generating device using an RF cavity for acceleration are at ground potential. This enables better reliability and lower cost of the components.

To achieve fast electron beam energy modulation within an RF cavity, the RF power has to be modulated at the same rate as the required beam energy modulation frequency. This is well within the capability of state-of-the-art RF power generation. For example, two RF power supply output waveguides can be coupled allowing high power output if both supplies are active and lower power if only one of the two supplies is active.

Other advantages will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention. In the drawings.

DETAILED DESCRIPTION OF PREFERRED EMBODIMENTS

Figure 1A:
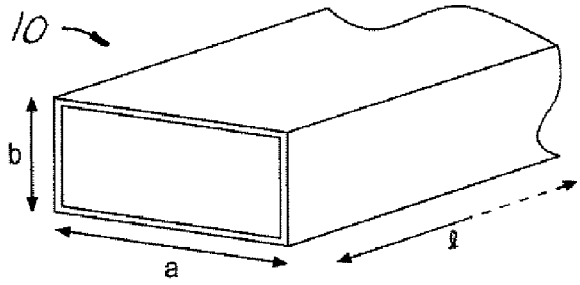
FIG. 1A is a rectangular waveguide cavity.
Figure 1B:
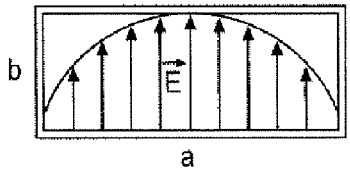
FIG. 1B is an example of the $TE_{10}$-mode electric field distribution a in a rectangular waveguide.
Figure 1C:
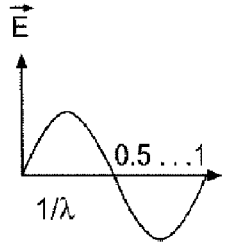
FIG. 1C is the electromagnetic wave.

Referring to FIGS. 1A, 1B and 1C, there is shown an example of the electric field distribution for the $TE_{10}$-mode in a rectangular waveguide. The waveguide cavity 10 has a width dimension, a; a height dimension, b; and a length, l as shown in FIG. 1A. FIG. 1B shows the electric field distribution E at a particular moment in time, in the cavity 10 for $TE_{10}$-mode of the electromagnetic wave, E shown in FIG. 1C.

Figure 2:
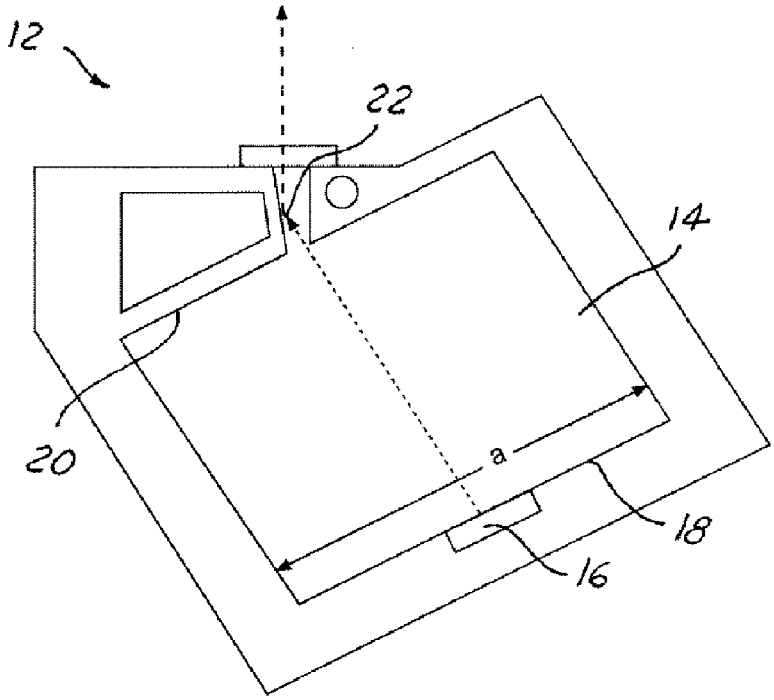
FIG. 2 is a cross section of a waveguide electron accelerator of the present invention.

Referring now to FIG. 2, the accelerator is shown in cross section as a CT arc source 12 application. A rectangular wave-guide cavity 14 has an electron emitter 16 placed on the bottom face 18, which corresponds to the width dimension, a, of the rectangular waveguide. For an electric field distribution as shown in FIG. 1B, the electrons emitted from the source are accelerated across the guide, along the path corresponding to the height dimension, b, to the opposing, or upper face, 20 of the cavity 14. During the negative half wave of the electric field, as in FIG. 1C for $1/\lambda=0.5$ 1, no electrons are emitted. It is possible to achieve electron energies of around 150 keV over a path of one to two centimeters in height. The accelerated electrons are then used to generate x-rays in the conventional manner by interacting with a solid target, 22.

The waveguide 14 is essentially an RF cavity. RF frequencies in the cavity may be several GHz. The low frequency cutoff, $\lambda_c$, is determined by the geometry of the cavity (see FIG. 1A).

$$\lambda_c = \frac{2}{\sqrt{\left(\frac{m}{a}\right)^2 + \left(\frac{n}{b}\right)^2}}$$

Also, the resonance frequency, $\lambda_r$, is determined by the geometry of the cavity and integers m, n, and q.

$$\lambda_r = \frac{2}{\sqrt{\left(\frac{m}{a}\right)^2 + \left(\frac{n}{b}\right)^2 + \left(\frac{q}{l}\right)^2}}$$

For $TE_{10}$ mode, m=1, n=0, and the frequency is determined only by the width dimension, a. For a=10 cm the cutoff frequency, $\lambda_c$, would be 1.5 GHz. A resonant cavity with a cross sectional dimension on the order of 10 cm could be readily integrated in existing CT and other medical x-ray imaging systems. For an electron beam current of 1 Ampere and an accelerating voltage on the order of 150 kV, the supplied microwave power must be at least 150 kW, or 150 kV*1 A. A microwave generator providing GHz-microwave frequencies and mega watt power is state of the art and known in the areas of telecommunications and accelerator technology. A Klystron is just such an example. A Klystron may be used for microwave-generated electric fields in the waveguide structure in accordance with the present invention to generate x-rays.

The microwave power, the waveguide dimensions, and the phase of the electromagnetic wave all determine the energy of the electrons impinging on the target. According to the present invention, there is no need for static high-voltage to accelerate the electron beam. Therefore, static high-voltage stability is no longer a concern and the need for costly and bulky high voltage insulator used in prior art arc sources is eliminated.

Figure 3:
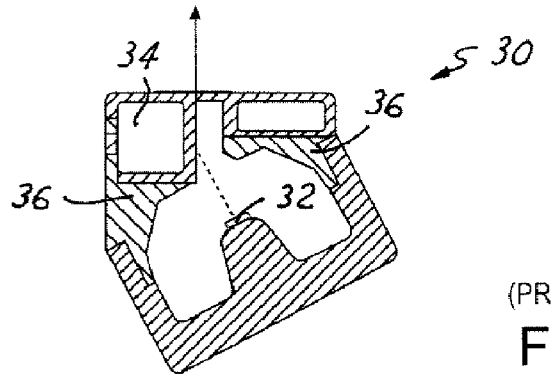
(PRIOR ART) FIG.3
FIG. 3 is a prior art arc-source having a high voltage insulator.

FIG. 3 is a prior art arc source 30 having a field emission cathode 32 that directs electrons onto a target. A water-filled cooling chamber 34 cools the source, and a solid high voltage insulator 36 must be incorporated to maintain high voltage.

Referring again to FIG. 2, no high voltage insulator is required. Microwaves are coupled into the waveguide. In the waveguide, it is possible to generate oscillations of various configurations, namely standing or traveling waves, by appropriately tuning and terminating the resonant cavity structure. The electron emitter 16 may be a field emission array (FEA) that is electrically gated. The electron beam is generated only in the area where the gate is open. Therefore, the location of the focal spot along the arc can be controlled electrically through the control of the electron beam.

The energy of the electrons striking the target 22 depends on several factors. The phase of the electromagnetic wave relative to the time that an electron leaves the emitter is one factor that will affect the energy. The energy is also affected by the location of the emitted electron with respect to the spatial amplitude of the electromagnetic wave. In addition, the power of the microwaves affects the energy of the electrons. At least these three factors are used to generate electron beams with different average energies. The ability to alter, or vary, the average energies is of particular interest for specialized imaging techniques.

A significant advantage is the fact that strong electric fields, greater than 10 kV/mm, can be sustained in resonant cavities without the need for solid insulation. Electron energies on the order of up to 200 keV can be reached in a space as small as about 20 mm in length with an RF frequency on the order of 12 GHz. Therefore, designs are not limited by the need for bulky and expensive high voltage insulators.

Figure 4:
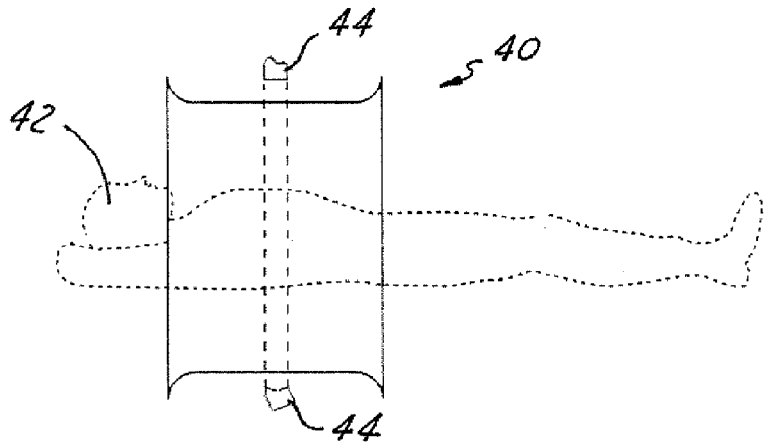
FIG. 4 is a stationary CT system incorporating the waveguide arc source of the present invention.

FIG. 4 is an example of an application in a stationary CT apparatus 40. A subject 42 remains stationary while the arc source 44 of the present invention generates x-rays. The arc source is moved along the subject 42 and an image is generated by combining image slices into one complete image. It should be noted that the dimensions shown in FIG. 4 are for example purposes only.

Figure 5:
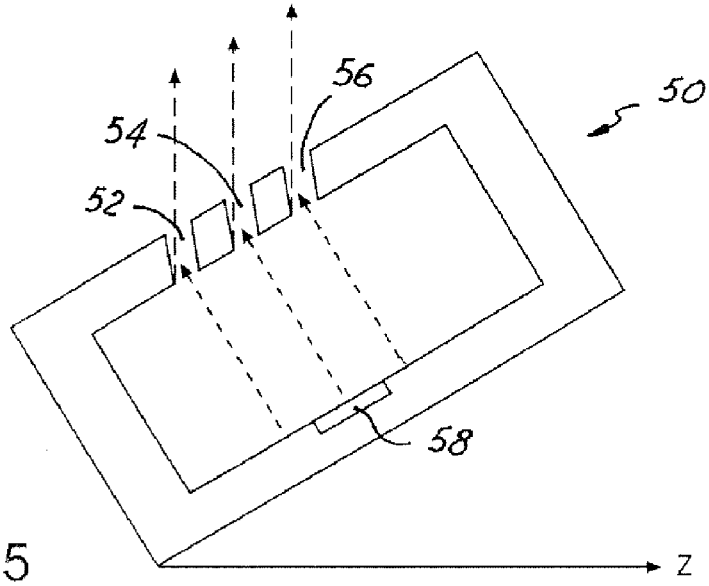
FIG. 5 is a multi-slotted waveguide for one embodiment of the present invention.

FIG. 5 is another application for the accelerator of the present invention. A multi-slotted waveguide 50 is used to collimate the x-rays and create a larger coverage area for the x-ray beam. Such an extended coverage is needed in volume CT applications so that the time it takes to create the images and the hospital's ability to diagnose problems is reduced. FIG. 5 shows three slots 52, 54, 56 for example purposes only. One skilled in the art is capable of modifying the slot dimensions and the number of slots without departing from the scope of the invention. The electron source 58 may be a field-emitter electron source.

Figure 6:
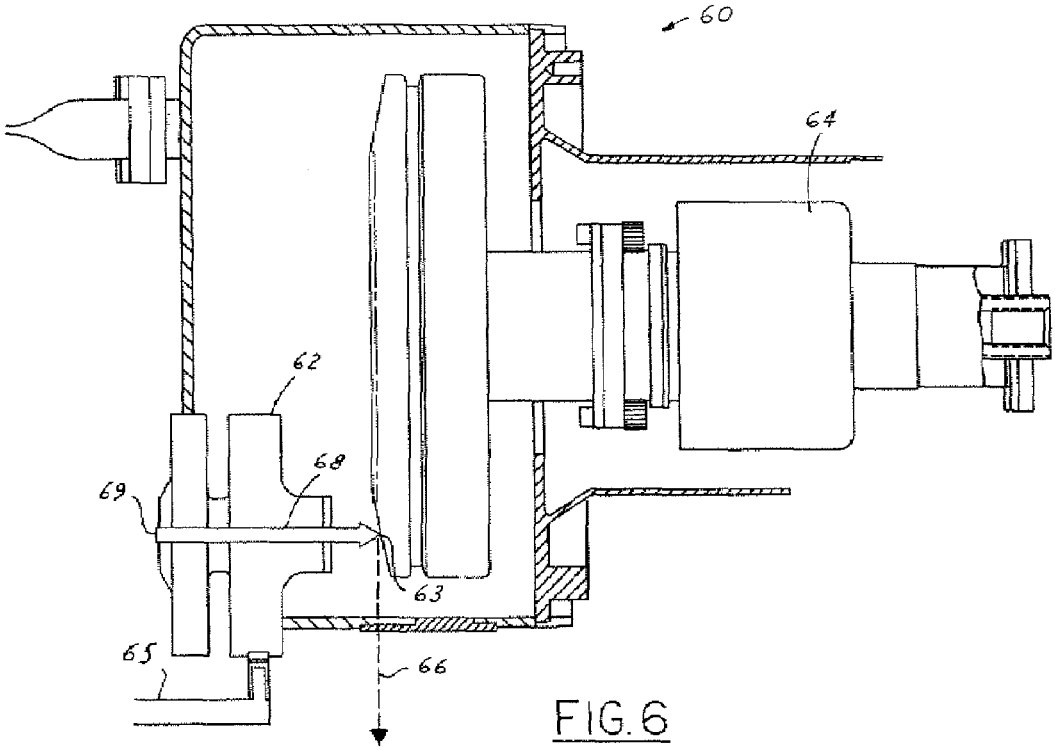
FIG. 6 is a rotating x-ray tube with an RF electron beam accelerator of the present invention.

In yet another application, the RF electron beam accelerator 62, shown in FIG. 6, is used in a rotating x-ray tube 60. The anode target 63 rotates about an axis 64 and the x-ray beam 66 is generated by an electrode beam 68 from emitter 69 striking the anode target 63. The accelerator 62 is coupled to a Klystron, not shown by way of waveguide 65.

Figure 7:
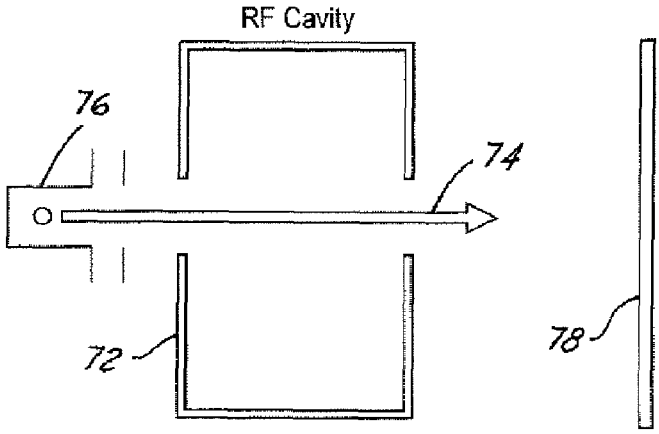
FIG. 7 is an RF cavity energy booster for a cathode electron gun.

Still another application, shown in FIG. 7, the RF electron beam accelerator 72 is used to boost the energy of an electron beam 74 as it exits a cathode or e-gun source 76 and is directed to a target 78. The source 76 can be operated below 10 kV, and the RF cavity 72 boosts the electron beam energy up to 100 to 200 kV.

The invention covers all alternatives, modifications, and equivalents, as may be included within the spirit and scope of the appended claims.

What is claimed is:

1. An accelerator for an electron beam used in the generation of x-rays, the accelerator comprising:

a waveguide cavity having a bottom face and a face opposite the bottom face;

an electron emitter placed within the bottom face of the waveguide cavity for generating electrons that are accelerated through the waveguide cavity; and means for directing the accelerated electrons through a plurality of openings extending through the face opposite the bottom face to a plurality of solid targets extending beyond the face opposite the bottom face on each of the plurality of openings for collimating the accelerated electrons and generating a fan-shaped x-ray beam.

2. An arc source for a stationary computed tomography apparatus comprising:

a waveguide cavity having a bottom face and a face opposite the bottom face;

at least one electron emitter placed within the bottom face of the waveguide cavity for generating electrons that are accelerated through the waveguide cavity;

a plurality of openings extending through the face opposite the bottom face to a plurality of solid targets extending beyond the face opposite the bottom face on each of the plurality of openings for collimating the accelerated electrons and generating a fan-shaped x-ray beam.

3. An electron beam accelerator for a rotating anode comprising:

a waveguide cavity having a bottom face and a face opposite the bottom face;

an electron emitter placed within said waveguide cavity on the bottom face for generating electrons that are accelerated through the waveguide cavity;

a rotating anode target on the face opposite the bottom face for interaction with the accelerated electrons for the generation of x-rays.

4. The electron beam accelerator as claimed in claim 3 wherein the face opposite the bottom face further comprises a plurality of slots and the rotating anode target further comprises a target on each of the plurality of slots for collimating the accelerated electrons and generating a fan-shaped x-ray beam.

5. The electron beam accelerator as claimed in claim 3 wherein the electron emitter further comprises a field emission array that is electrically gated.

6. The electron beam accelerator as claimed in claim 5 wherein the electron beam is focused by shaping the field emission array using the electrical gates.

7. The electron beam accelerator as claimed in claim 3 further comprising means for tuning and terminating the waveguide cavity for generating oscillations of a desired configuration.

8. The electron beam accelerator as claimed in claim 3 wherein the waveguide cavity further comprises:

a rectangular geometry having a predetermined width, length and height; and a cutoff frequency determined by the rectangular geometry of the waveguide cavity.

* * * * *